US006363952B1

(12) United States Patent
Baioff et al.

(10) Patent No.: US 6,363,952 B1
(45) Date of Patent: Apr. 2, 2002

(54) CLEANING APPARATUS FOR PAINT APPLICATOR HEADS

(75) Inventors: Danny Baioff, Tecumseh; David A. Tiessen, Cottam; Gil Boucher, Tecumseh, all of (CA)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/458,137

(22) Filed: Dec. 9, 1999

(51) Int. Cl.[7] ..... B08B 9/00
(52) U.S. Cl. ..... 134/111; 134/169 R
(58) Field of Search ..... 134/111, 169 R, 134/171, 199

(56) References Cited

U.S. PATENT DOCUMENTS

| | | | | | |
|---|---|---|---|---|---|
| 1,672,286 | A | * | 6/1928 | Stringham et al. | 134/111 X |
| 2,175,677 | A | * | 10/1939 | Zademach | 134/111 X |
| 2,568,183 | A | * | 9/1951 | Bumpus | 134/199 X |
| 3,103,936 | A | * | 9/1963 | Nolte | 134/199 X |
| 4,768,533 | A | * | 9/1988 | Hall | 134/199 X |
| 4,785,836 | A | | 11/1988 | Yamamoto | |
| 4,793,369 | A | | 12/1988 | Robb et al. | |
| 4,881,561 | A | | 11/1989 | Schwarzwalder | |
| 5,174,317 | A | | 12/1992 | Robb et al. | |
| 5,485,860 | A | | 1/1996 | Robb et al. | |
| 5,499,643 | A | | 3/1996 | Vincent, Jr. et al. | |
| 5,551,461 | A | * | 9/1996 | St. Martin | 134/199 X |
| 5,894,993 | A | | 4/1999 | Takayama et al. | |

FOREIGN PATENT DOCUMENTS

| | | | | |
|---|---|---|---|---|
| BE | 563072 | * | 12/1957 | 134/111 |
| FR | 1.324.162 | * | 3/1963 | 134/111 |

* cited by examiner

*Primary Examiner*—Philip R. Coe
(74) *Attorney, Agent, or Firm*—Mark P. Calcaterra

(57) ABSTRACT

Paint accumulations can be removed from paint atomizer applicator heads by passing pressurized solvent through the heads for prolonged time periods, e.g. one hour or more. Several paint applicator heads can be connected to an overhead piping system located in a treatment tank, so that solvent and entrained particulates can collect in the tank. An external filter and motor-operated pump can be connected to the tank and piping system for recirculating the solvent through the paint applicator heads on a continuing basis.

9 Claims, 3 Drawing Sheets

CLEANING APPARATUS FOR PAINT APPLICATOR HEADS

BACKGROUND AND SUMMARY OF THE INVENTION

This invention relates to an apparatus for cleaning paint applicator heads, e.g. paint atomizer heads used for applying paint to automotive vehicles.

Paint atomizer heads are used during the automotive vehicle manufacturing process to coat the vehicle exterior surfaces with various different colored paint. In conventional automotive vehicle manufacture the vehicle bodies are painted in a tunnel-type paint booth. Typically the skeleton bodies are placed on a conveyor that moves slowly through different chambers in an elongated tunnel (or booth). As each vehicle body moves slowly along the tunnel different painting operations and drying operations are preformed on different surfaces of the vehicle body.

Various different paint colors are applied to the different vehicle bodies, depending on production requirements. Periodically, it is necessary to change the paint coloration supplied to the paint applicator mechanisms, e.g. when one vehicle is to have a blue coloration and the next vehicle body is to have a red coloration.

When it is necessary to change the paint coloration supplied to the paint applicator mechanisms, a paint solvent is passed through the paint supply passages, paint applicator mechanisms, and paint return passages. The solvent initially acts as a pump to move most of the paint out of the passages, and later as a cleaner to dissolve and remove residual paint from the passage walls. The process of removing paint from the various passages is sometimes referred to as the purge cycle. Typically the purge cycle takes about fifteen or twenty seconds while the vehicle bodies continue moving along the conveyor. The vehicle bodies continually move through the paint booth during the purge cycle and during the time required to load the new paint coloration into the applicator mechanisms.

One type of paint applicator mechanism commonly used is a rotary paint atomizer head. Typically, the paint atomizer head is connected to a rotary hollow shaft that supplies paint to a central chamber in the atomizer head. Paint flows from the central chamber onto a dish-like surface of the head, where centrifugal force causes the paint to be thrown off the outer peripheral edge of the head toward the vehicle surface.

During the aforementioned purge cycle, paint solvent is pumped into the central chamber of the paint atomizer head, so that paint on the head surfaces is assimilated into the solvent, whereby the head surfaces are cleaned for receiving new paint colorant.

The purge cycle is of relatively short duration so that in some cases residual traces of paint may remain on certain surfaces of the atomizer head. Over time these paint accumulations can adversely affect the flow of paint through the atomizer head, or otherwise degrade the painted vehicle surface to a point where excessive manual sanding operations are required on the vehicle.

It is a practice to periodically remove the atomizer heads from the paint supply apparatus for hand cleaning or replacement with new atomizer heads. Hand cleaning is time-consuming and hence costly. The present invention relates to a cleaning system for paint applicator heads (paint atomizer heads) that is efficient and at the same time relatively automatic, whereby a given cleaning operation can be performed with minimal human effort. The principal aim of the invention is to reduce the cost of the paint application head cleaning operation. An apparatus embodying the invention can include a treatment tank containing a piping system designed to supply paint solvent to several discharge fittings. Each fitting is connectable to an individual paint applicator head, whereby solvent is caused to flow from the piping system through the applicator heads into the tank interior space.

The solvent, with entrained paint particles, collects in the bottom of the treatment tank, from where it is passed through an external filter for removal of the paint particulates. A motor-operated pump returns the solvent to the aforementioned piping system for recirculation through the applicator heads.

The cleaning apparatus enables the solvent to be recirculated and reused on a continuing basis, without any requirement for human control or human attention. A cleaning operation can be performed automatically for a given time period, e.g. one hour, after which the applicator heads can be removed from the treatment tank in cleaned conditions.

A principal advantage of the invention is that the cleaning operations can be carried forward for an extended period of time, without human attention or control, so that the cleaning operation is relatively inexpensive. The apparatus can include multiple fittings within the treatment tank, whereby several paint applicator heads can be cleaned at the same time, thereby reducing the cost for cleaning each paint applicator head. Various types of paint applicator heads and paint nozzles can be treated (cleaned) in a given apparatus. The apparatus has general application for a range of cleaning functions.

Specific features and advantages of the invention will be apparent from the attached drawings and description of an apparatus embodying the invention.

DESCRIPTION OF A PREFERRED EMBODIMENT OF THE INVENTION

Figure 1:
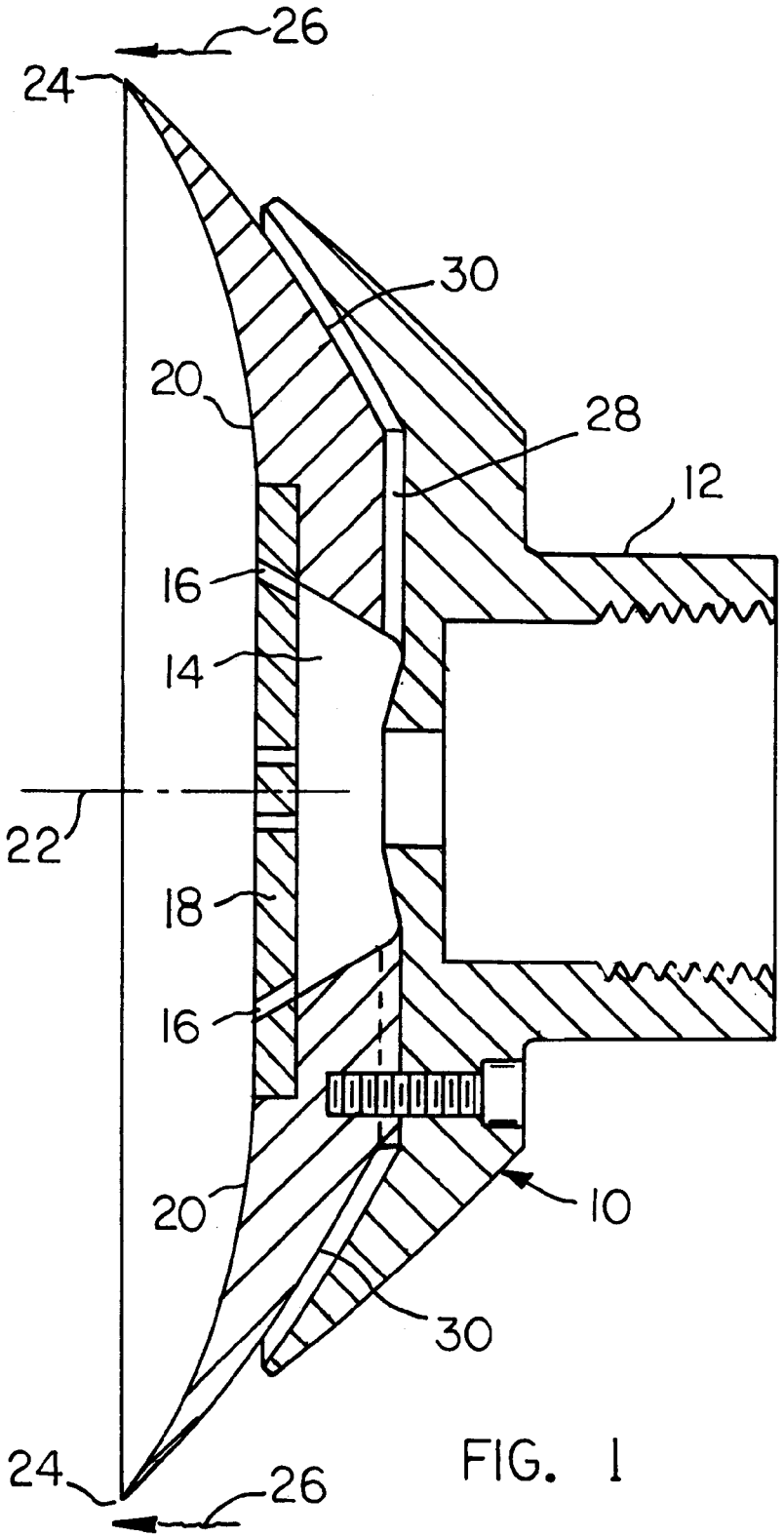
FIG. 1 is a sectional view taken through a paint (coating) applicator head that can be cleaned by an apparatus of the present invention.

FIG. 1 shows a paint applicator head (or nozzle) that can be cleaned with the apparatus of the present invention. The paint applicator head is a commercially available piece of equipment used in the automotive manufacturing industry for applying paint (coating) to the exterior surfaces of automotive vehicle bodies in a production environment.

As shown in FIG. 1, the coating applicator head 10 includes a two-piece nozzle having an internally threaded hub 12 adapted to be threaded onto a rotatable hollow shaft (not shown), whereby flowable paint (coating) can be supplied to a central chamber 14. A ring of holes (ports) 16 is formed in wall 18 of the head for conducting the flowable coating material from chamber 14 onto a dish-like exterior surface 20.

Applicator head 10 is rotatable around central axis 22, whereby the coating material on surface 20 is centrifugal moved onto the circular peripheral edge 24 of surface 20. An annular air-directing mechanism (not shown) provides an annular blast of air, designated by numeral 26, so that the flowable coating material is atomized into a fine spray as it is discharged from peripheral edge 24 toward the vehicle surface.

When it becomes necessary to change the color of the coating applied to the next vehicle body, a paint solvent is supplied to central chamber 14 (before feeding the new colorant coating). The solvent flows along dished surface 20 onto peripheral edge 24; additionally some solvent will flow through passages 28 onto the rear surface 30 of the applicator head for achieving an additional cleaning action on peripheral edge 24.

The cleaning period is sometimes referred to as a purge cycle. Typically, the purge cycle takes about fifteen seconds; during the purge cycle the coating applicator head is rotating to promote a desired flow of solvent.

Due to the relatively short duration of the purge cycle, the surfaces of the coating applicator head may not always be completely cleaned. After prolonged usage of the applicator head there may be some build up of coating material. The present invention concerns a cleaning apparatus for removing the accumulation of solid particulate material on the surfaces (and in the passages) of the coating applicator head. One embodiment of the cleaning apparatus of the present invention is shown in FIGS. 2 and 3.

Figure 2:
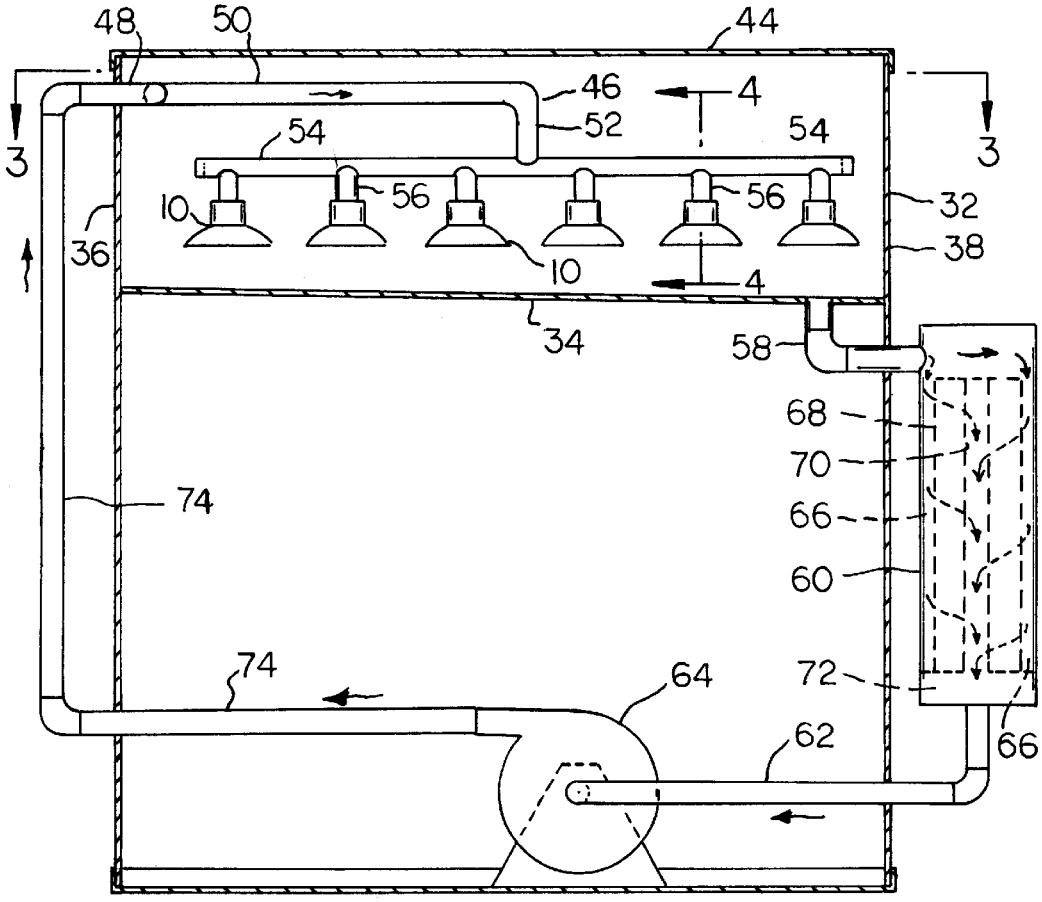
FIG. 2 is a sectional view, taken on line 2—2 in FIG. 3, and showing a cleaning apparatus of the present invention.
Figure 3:
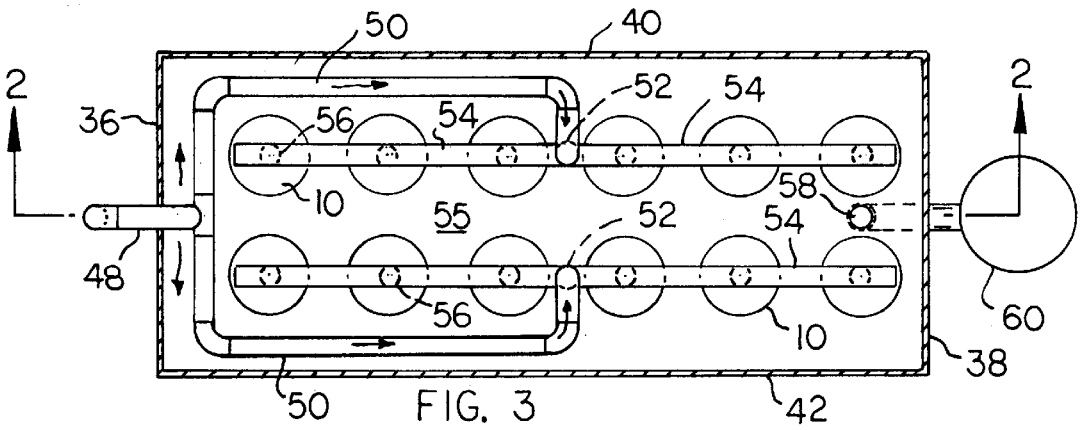
FIG. 3 is a sectional view taken on line 3—3 in FIG. 2.

Referring to FIGS. 2 and 3, the illustrated apparatus includes a rectangular treatment tank 32 defined by a bottom wall 34, two end walls 36 and 38, and two side walls 40 and 42. The upper open end of the tank is normally closed by a rectangular lid 44 that has a hinged connection with tank side wall 40. The lid can be raised from its closed position in order to gain access to the tank interior space.

Located within tank 32 is solvent piping system 46 that includes a solvent intake pipe 48 extending horizontally through end wall 36 of the tank. Pipes 50 extend horizontally from intake pipe 48, and then downwardly, as at 52, to supply solvent to two similarly constructed distributor pipes 54.

Solvent discharge fittings 56 extends downwardly from each distributor pipe 54 to supply solvent to the intake passages of individual coating applicator heads 10.

The piping system shown in FIGS. 2 and 3 is designed to supply pressurized solvent to twelve coating applicator heads 10 (six heads for each distributor pipe 54). However, the number of discharge fittings 56 is variable, depending on the anticipated cleaning requirement.

Figure 4:
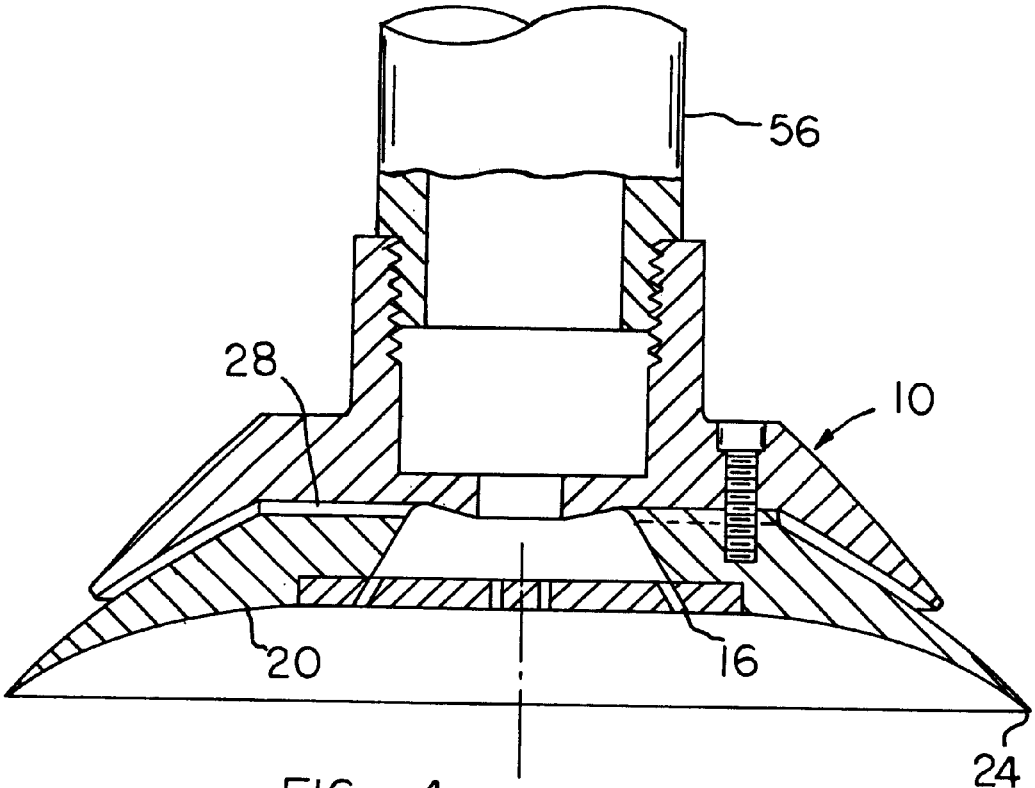
FIG. 4 is an enlarged fragmentary section taken on line 4—4 in FIG. 2.

FIG. 4 shows the relation between each discharge fitting 56 and an associated coating applicator head 10. The fitting includes a pipe that is externally threaded at its lower end, whereby the hub portion of the applicator head can be screwed onto the pipe to establish a fluid flow connection between the pipe and the passage system within the associated applicator head 10. Solvent is enabled to flow downwardly through pipe 56 and head 10 in sequential fashion, to remove coating particulates from surface areas of the head, especially ports 16, dished surfaces 20, passages 28, and peripheral edge 24. Solvent, with entrained particulates, is collected on tank bottom wall 34.

As shown in FIG. 2, bottom wall 34 slopes downwardly in a left-to-right direction, so that the solvent-particulate mixture tends to accumulate on wall 34 near end wall 38. The fluid mixture is conveyed out of the treatment tank via a drain conduit 58 that connects to the upper end of an external filter 60.

The fluid mixture flows downwardly within the filter housing and into a second conduit 62 that connects with a motor-operated pump 64. During downward flow through the filter the coating particulates are retained within the filter media, so that the fluid supplied to pump 64 is essentially fresh (pure) solvent.

Various different solvents can be used to loosen and remove coating particulates from the surfaces of applicator heads 10, depending on the nature of the coating material used in the vehicle body painting operation. One suitable solvent is a material marketed under the name CHEMKLEEN 522 FD.

Filter 60 can utilize various types of filter media, e.g. woven cloth fabric, metal screening, or sand, supported within the filter housing to provide the desired gravitational flow and particle-retention property. As shown schematically in FIG. 2, the filtration media 68 has an annular tubular configuration within the filter housing, whereby the solvent flows from an annular inlet chamber 66 through the filtration media 68 into an axial passage 70 that communicates with an outlet chamber 72 in the bottom end of the filter housing.

Filter 60 can take various forms and configurations. However, the filter is preferably a low cost gravity filter located outside tank 32 and below the tank bottom wall 34. As shown in FIG. 2, end walls 36 and 38 of the tank extend downwardly beyond tank bottom wall 34, to elevate the tank above filter 60. With this arrangement, the solvent-particulate mixture can drain from tank 32 through drain conduit 58 into the filter. Within filter 60 the solvent flows downwardly, due to gravitational force and the suction force generated by pump 64.

The outlet of pump 64 connects with a third conduit 74 that extends horizontally and then vertically upwardly to direct the pressurized solvent into the aforementioned intake pipe 48. The piping arrangement provides a closed circuit, that includes pump 64, conduit 74, piping system 46, the individual paint applicator heads 10, drain conduit 58, filter 60, and conduit 62. Solvent can be continuously recirclated through the closed circuit, as long as pump 64 is in operation. The cleaning operation can continue for a prolonged period (e.g. one hour) without human attention.

Periodically, it may be necessary to replace the solvent or add make-up solvent. This can easily be accomplished by opening lid 44 and pouring fresh solvent into tank 32. A drain valve can be provided in tank bottom wall 34, should it become necessary to remove unusable solvent from the tank.

Lid 44 has to be opened in order to connect the individual paint applicator heads to discharge fittings 56 (or disconnect such heads from the fittings). Pipes 50 are configured so as to provide unobstructed access to the central space 55 between solvent distributor pipes 54. The individual applicator heads can be moved through the central unobstructed space to accomplish the connection or disconnection process.

What is claimed:

1. An apparatus for removing coating particulate from coating applicator heads, said apparatus comprising:

a treatment tank;

a coating-solvent piping system comprising two elongated parallel distributor pipes extending horizontally within said tank; said piping system further comprising a solvent intake pipe, and plural solvent discharge fittings; each said discharge fitting being adapted to connect with an intake passage of a coating applicator head, whereby solvent is enabled to flow from the piping system through the connected applicator heads into the interior space within the tank, said solvent discharge fittings comprising branch pipes extending downwardly from said distributor pipes, whereby each distributor pipe supplies solvent to several discharge fittings;

a filter located outside said treatment tank;

a solvent pump located outside said treatment tank;

a first conduit means connecting said tank to said filter, a second conduit means connecting said filter to said pump, and a third conduit means connecting said pump to said intake pipe, whereby a closed circuit is established for recirculating solvent through the applicator heads on a continuing basis.

2. The apparatus of claim 1, wherein said treatment tank has a bottom wall adapted to receive particulate-laden solvent from the coating applicator heads located within the tank.

3. The apparatus of claim 2, wherein said first conduit means extends downwardly from the bottom wall of the tank.

4. The apparatus of claim 2, wherein said first conduit means comprises a drain line extending downwardly from the tank bottom wall.

5. The apparatus of claim 1, wherein said treatment tank is elevated above said filter, so that particulate-laden solvent drains from the tank through said first conduit means into the filter.

6. The apparatus of claim 1, wherein said filter is a gravity filter having an upper end and a lower end; said first conduit means being connected to the upper end of the filter, and said second conduit means being connected to the lower end of the filter.

7. The apparatus of claim 1, wherein each said downwardly-extending branch pipe has a threaded lower end adapted to have a screw-on connection with a coating applicator head.

8. The apparatus of claim 1, wherein said treatment tank has a hinged lid that can be raised to an open position for connecting the coating application heads to said discharge fittings.

9. The apparatus of claim 1, wherein said treatment tank is a rectangular tank having a hinged lid for access to the tank interior space; said tank having a sloped bottom wall for collecting solvent that has passed through the applicator heads; said piping system being located in the upper portion of the tank, whereby the applicator heads are suspended below the piping system; and said distributor pipes being spaced apart to define an unobstructed central space that can be used for connecting the application heads to the discharge fittings.

* * * * *